US005382214A

United States Patent [19]

Mano

[11] Patent Number: 5,382,214

[45] Date of Patent: Jan. 17, 1995

[54] METHOD FOR FABRICATING A CARDBOARD PALLET AND AN APPARATUS FOR FABRICATING THE SAME

[75] Inventor: Toshiyuki Mano, Numazu, Japan

[73] Assignees: Iwatani Sangyo Kabushiki Kaisha, Osaka; Nikki Box Stitching Machine Co, Ltd., Shizuoka, both of Japan

[21] Appl. No.: 73,493

[22] Filed: Jun. 9, 1993

[51] Int. Cl.[6] ..... B31D 1/00; B31D 3/04; B65D 19/34

[52] U.S. Cl. ..... 493/89; 493/331; 493/964; 108/54.1; 206/599

[58] Field of Search ..... 493/89, 331, 343, 350, 493/390, 964, 965; 108/51.63, 54.1, 56.3; 206/599

[56] References Cited

U.S. PATENT DOCUMENTS

| | | | |
|---|---|---|---|
| 2,528,413 | 10/1950 | Budd | 493/331 |
| 3,071,045 | 1/1963 | Budd | 493/89 |
| 3,214,015 | 10/1965 | Budd | 206/599 |
| 3,266,444 | 8/1966 | Budd | 108/54.1 |
| 4,244,766 | 1/1981 | Yellen | 156/211 |
| 4,487,136 | 12/1984 | Beckway | 108/51.3 |
| 4,697,699 | 10/1987 | Schneider | 206/599 |
| 4,850,284 | 7/1989 | DeGroot et al. | 108/56.3 |

FOREIGN PATENT DOCUMENTS 1454173 11/1976 United Kingdom .

*Primary Examiner*—William E. Terrell
*Attorney, Agent, or Firm*—Bacon & Thomas

[57] ABSTRACT

A method for fabricating a cardboard pallet and an apparatus for fabricating continuously and at a high speed a cardboard pallet having cardboard tubular leg members arranged and secured integrally to a cardboard table element is provided. After an adhesive has been applied to both side surfaces of a plurality of attachment portions of the cardboard table element with the attachment portions having a plurality of adhesion finger members formed by die-cut lines defined inside of a phantom folding line, open ends of outer leg elements are brought into contact with one side surface of the attachment portions and inner leg elements located on the other side surface of the attachment portions are pushed into the outer leg elements so that leg members can be secured uprightly to one side surface of the table element.

5 Claims, 13 Drawing Sheets

METHOD FOR FABRICATING A CARDBOARD PALLET AND AN APPARATUS FOR FABRICATING THE SAME

BACKGROUND OF THE INVENTION

1. Field of the Invention

The present invention relates to a method for fabricating a cardboard pallet by utilizing a cardboard, a corrugated cardboard and the like and an apparatus for fabricating the same.

2. Description of Prior Art

Conventionally wood has been widely used in forming pallets, such a wooden pallet constructed being generally of an upper and a lower wood plates and wood crosspieces interposed therebetween. But, disadvantageously it is impossible to recycle the wooden pallet and there are several countries which regulate strictly the utilization of wood, for example so as to prohibit a wooden pallet as a carriage base for imported goods under a recent circumstance in which preservation of nature is proposed.

Therefore, when a cardboard pallet is used instead of the wooden pallet, its recycle is possible which can decrease a possibility of a natural destruction and get a remarkably large utility value for the future.

Constructing a cardboard pallet is also known, for example as disclosed in the U.S. Pat. No. 448,736.

The conventional cardboard pallet comprises a table element having tubular leg members attached to its underneath and composed of nesting inner and outer tubular leg elements secured through adhesion finger members held therebetween.

Since the above-mentioned conventional cardboard pallet doesn't employ any wood at all and yet has a sufficient mechanical strength, its utility value is remarkably large.

Since it is, however, fabricated by hand working, it is impossible to manually fabricate it continuously and efficiently.

Therefore, there is a limit in the number of cardboard pallets to be fabricated, and additionally the price thereof is too high to be utilized widely.

Accordingly, it has been required to provide such a method for fabricating a cardboard pallet and an apparatus for fabricating the same in which cardboard pallets can be fabricated continuously in mass production so as to be provided inexpensively.

SUMMARY OF THE INVENTION

The present invention is directed to solving the abovementioned conventional drawbacks and proposes to comply with such conventional requirements. It is an object of the present invention to provide a method for fabricating a cardboard pallet and an apparatus for fabricating the same in which adhesive is applied onto upper and lower surfaces of a plurality of attachment portions of a table element each of which comprises a plurality of adhesion finger members defined by a plurality of die-cut lines inside an area surrounded by a phantom folding line, then an inner leg element is directed toward the attachment portion from the back side while an open end portion of an outer leg element is kept in contact with the upper surface of the attachment portion, and the adhesion finger members of the attachment portion are secured between the outer leg element and the inner leg element by pushing the inner leg element into the outer leg element, whereby the outer leg element can be secured uprightly to every attachment portion on one side of the table element.

Accordingly, since the outer leg element can be provided automatically upright on one side of the table element, the cardboard pallet, which was assembled by hand working conventionally, can be assembled continuously by a mechanical means at an extremely high speed so that it becomes possible to carry out a mass production of the cardboard pallet for attaining a remarkable effect in a physical distribution process.

Further, since the cardboard pallet to be fabricated has legs especially composed of the outer leg elements, the adhesion finger members and the inner leg elements integrally, it can have a very large mechanical strength enabling a transfer of a heavy freight placed thereon without being crushed and broken. Furthermore, since the pallet doesn't use any wood, its utility value is high from the viewpoint of natural preservation.

BRIEF DESCRIPTION OF THE DRAWINGS

The above and other objects, advantages and features of the invention will become apparent when considered with the following detailed description of preferred embodiments of the invention, made with reference to the accompanying drawings, in which.

DESCRIPTION OF THE PREFERRED EMBODIMENTS

Figure 1:
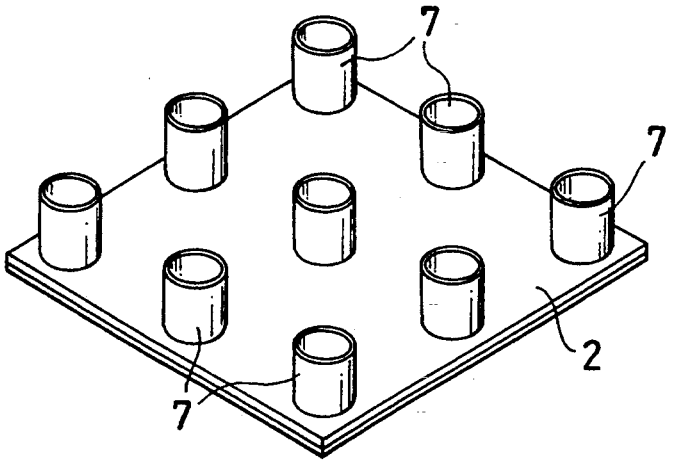
FIG. 1 is a perspective view of a cardboard pallet according to the present invention.
Figure 2:
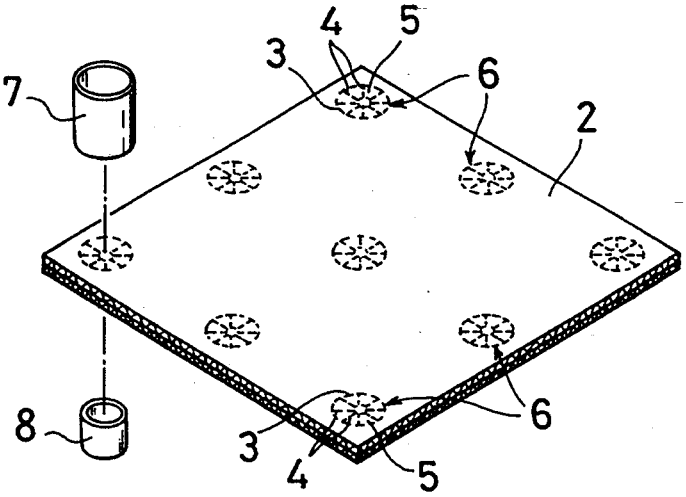
FIG. 2 is an exploded perspective view of component members of the cardboard pallet.
Figure 3:
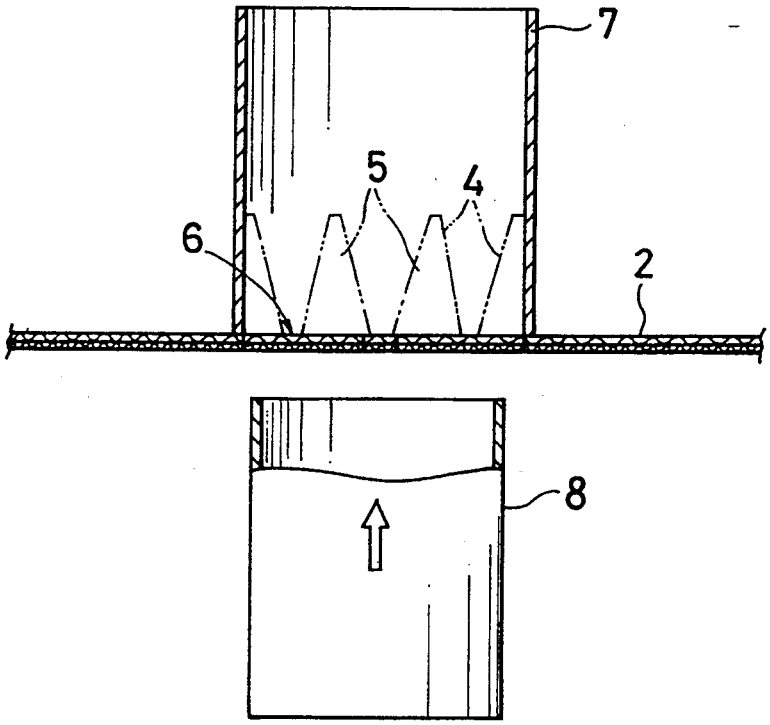
FIG. 3 is a vertical sectional view of a state before a mounting of a leg of the cardboard pallet.
Figure 4:
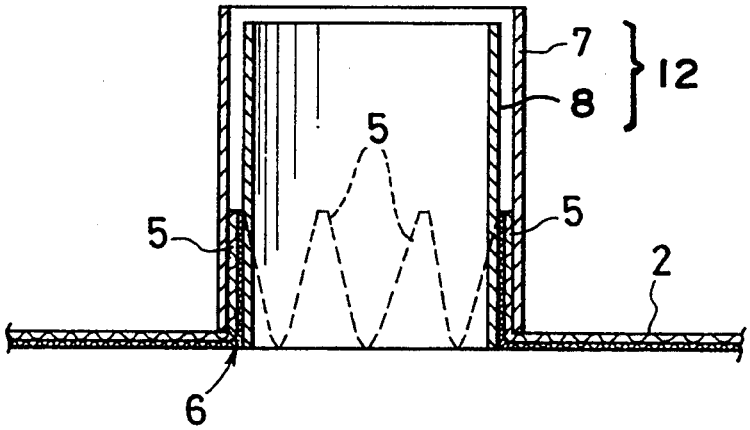
FIG. 4 is a sectional view of a state of the leg mounted to a table element of the cardboard pallet.

Now, embodiments of the present invention will be explained in detail with reference to the attached drawings hereinafter.

A method for fabricating a cardboard pallet 1 of the present invention comprises summarily an adhesion step for applying adhesive onto upper and lower surfaces of a plurality of attachment portions of a flat table element, a leg arranging step for locating an outer leg element and an inner leg element on respective upper and lower sides of each attachment portion so as to be brought into contact therewith respectively, and a pushing step for pushing an inner leg element into an outer leg element arranged to hold the table element therebetween so that the inner leg element can be fitted into the outer leg element.

The method for fabricating the cardboard pallet will be explained in detail hereinafter.

The flat table element 2 is made of a corrugated cardboard or a strong cardboard and is provided with a plurality of attachment portions 6 comprising a plurality of adhesion finger members 5 having an isosceles triangle defined by forming a plurality of die-cut lines diametrally in each area inside a circular phantom folding line 3 at a predetermined positions. In the illustrated embodiment, the attachment portions 6 are arranged side by side in three columns and three lines in parallel equidistantly throughout the surface of the table element 2, namely one attachment portion 6 at the center of the table element and three attachment portions 6 along each of four sides are disposed equidistantly.

An outer leg element 7 is brought into contact with the upper surface of the attachment portion 6 of the table element 2 while an inner leg element 8 is brought into contact with the lower surface thereof.

The outer leg element 7 has a cylindrical configuration with open opposite ends and an inner diameter equal to that of the phantom folding line 3. Also the inner leg element 8 has a cylindrical configuration with open opposite ends similarly to the outer leg element 7 while its outer diameter is shorter by twice a thickness of the table element 2 than the phantom folding line 3 and its length is the same as that of the outer leg element 7.

Accordingly, when the inner leg element 8 with its one end portion faced to the lower surface of each attachment portion 6 of the table element 2 is pushed upward into the outer leg element 7 with its one open end portion kept in contact with the upper surface of the attachment portion 6 after adhesive has been applied onto the upper and the lower surfaces of the attachment portion 6 surrounded by the phantom folding line 3 by a mechanical means, the respective adhesion finger members 5 are bent at the phantom folding line 3 so as to be held between the outer surface of the inner leg element 8 and the inner surface of the outer leg element 7. Therefore, the inner leg element 8 is pushed into the outer leg element 7 till the lower open end portion of the inner leg element 8 reaches the lower surface of the table element 2 so as to be fitted therein.

Since the outer leg portion 7 is provided uprightly at every attachment portion 6 on the upper surface of the table element 2 while the inner leg element 8 is held to the inner lower half portion of the outer leg portion 7 by the abovementioned operations, when the adhesive cures, the outer leg element 7, the adhesion finger members 5 and the inner leg element 8 are strongly secured to one another integrally. Thereby, a leg member 2 composed of the outer leg element 7 and the inner leg element 8 is integrally secured to the table element 2 in the upright manner, so that the cardboard pallet can be composed of the table element 2 and a plurality of leg members 2.

Since through-holes are formed by the inner leg elements 8 at the attachment portions 6,if required the cardboard pallet 1 may be provided with an upper plate 3 of a cardboard or a corrugated cardboard pasted to the upper surface of the table element 2 for plugging the openings of the through-holes, providing an aethetic outlook, adding a reinforcement effect and so on.

Figure 5:
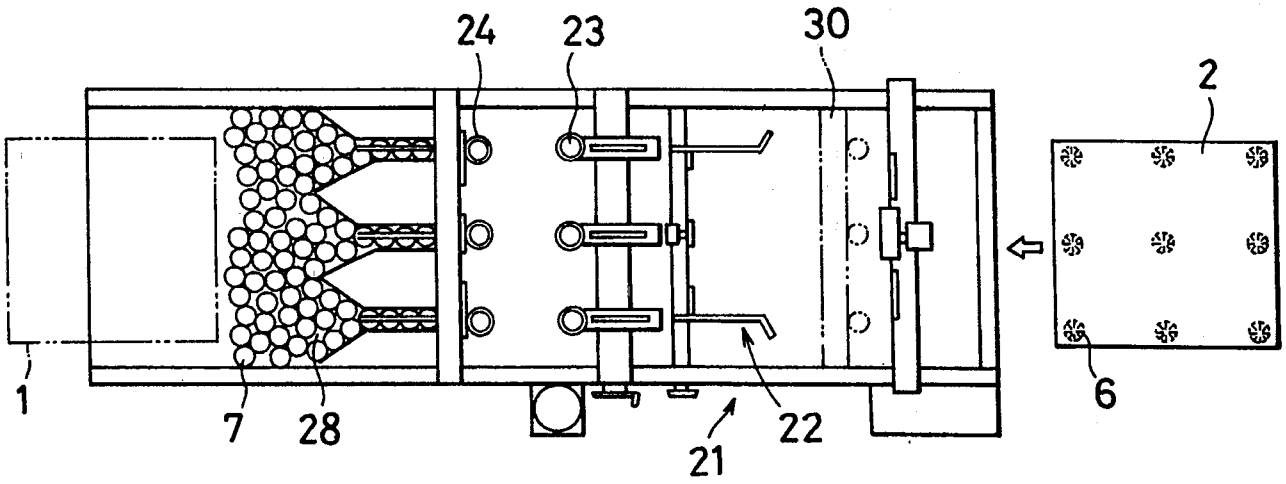
FIG. 5 is a schematic plan view of an apparatus for fabricating the cardboard pallet.

FIG. 5 shows a schematic plan view of a fabricating apparatus 21 for fabricating the above-mentioned cardboard pallet 1, which apparatus 21 is provided with an adhesive application mechanism 23 for applying the adhesive onto the upper and the lower sides of of the attachment portions 6 on a midway of a transfer line 22 for the table element 2 and a pushing mechanism 24 located behind the adhesive application mechanism 23 for pushing and fitting the inner leg element 8 into the outer leg element 7.

The transfer line 22 is adapted to move the table element 2 intermittently, for example by means of a plurality of loop-shaped chain-conveyers.

Figure 6:
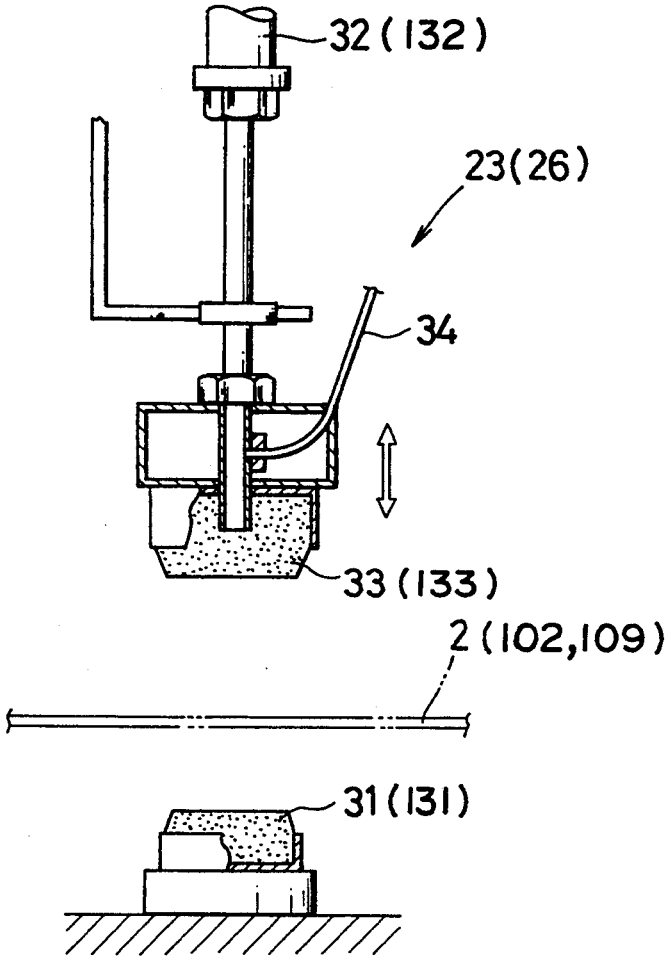
FIG. 6 is a schematic front view having cutout portions of an adhesive application mechanism.

The adhesive application mechanism 23 comprises, as shown in FIG. 6, a lower fixed application member 31 and an upper movable application member 33 opposed to the lower member 31 so as to be moved vertically by an actuation cylinder 32 and the like while the fixed application member 31 and the movable application member 33 are made of sponge, foamed resin and the like having fine communicating pores capable of being impregnated with liquid adhesive. A delivery line 34 for supplying the liquid adhesive is connected to the movable application member 33 so that the adhesive can remain always on the surfaces of the fixed application 25 member 31 and the movable application member 33. In the illustrated embodiment, since the delivery line 34 is connected only to the movable application member 33, the adhesive remains always on the surface of the movable application member 33 but the adhesive in the fixed application member 31 is consumed. Therefore, the movable application member 33 is adapted to perform a racing every certain time so that the adhesive can be supplied to the surface of the fixed application member 33.

When the adhesive delivery line is connected to either of the fixed application member 31 and the movable application member 33, it is unnecessary to perform the above-mentioned racing while it becomes possible to always keep a suitable amount of adhesive on the upper surfaces of the fixed application member 31 and the movable application member 33 by controlling a flow of the adhesive to be supplied.

Since three sets of the fixed application members 31 and the movable application members 33 are arranged transversely in the adhesive application mechanism 23, it is possible to simultaneously apply the adhesive to the upper and the lower surfaces of the three attachment portions 6 arranged transversely in the table element 2 by the operation of the fixed application members 31 and the movable application member 33.

Figure 7:
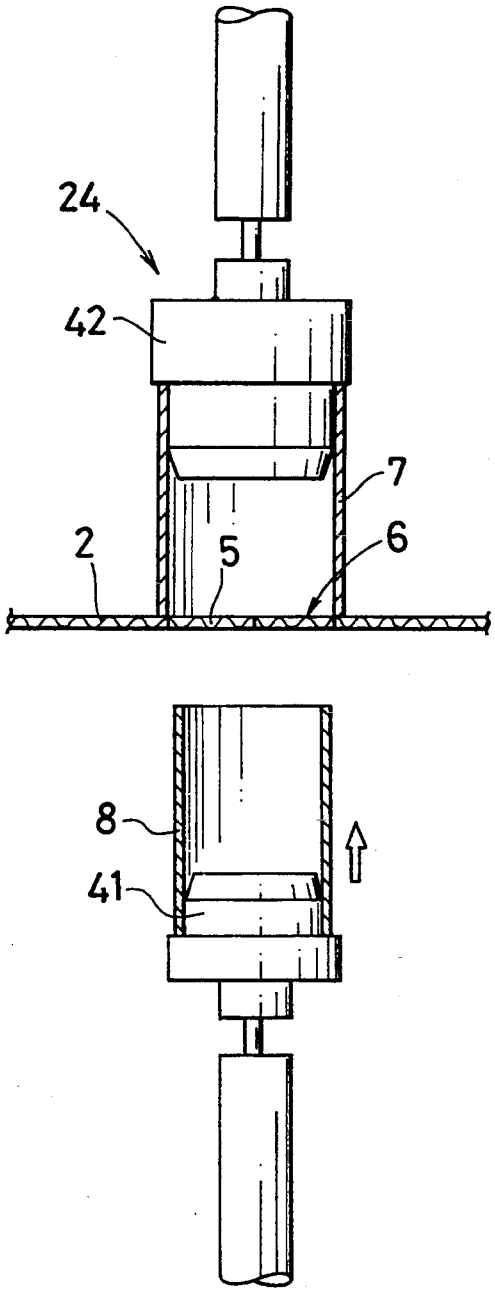
FIG. 7 is a schematic side view showing an operational state of a pushing process mechanism before an inner leg element is fitted into an outer leg element.
Figure 8:
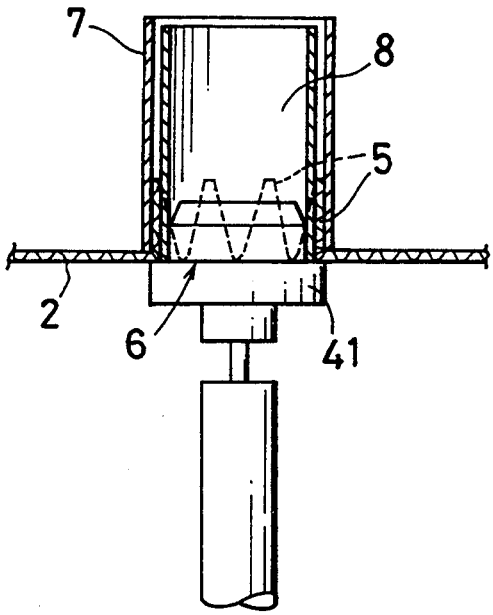
FIG. 8 is a schematic side view of the pushing process mechanism in such a state that the inner leg element has been fitted into the outer leg element.
Figure 9:
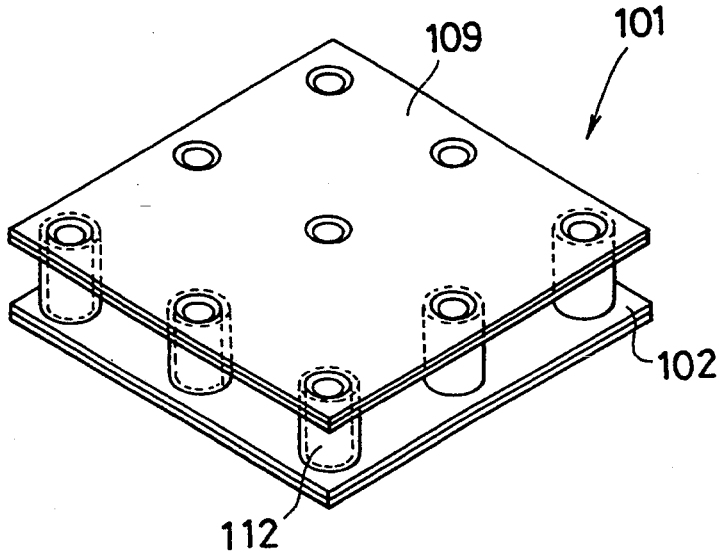
FIG. 9 is a perspective view of a cardboard pallet of a second embodiment of the present invention.
Figure 10:
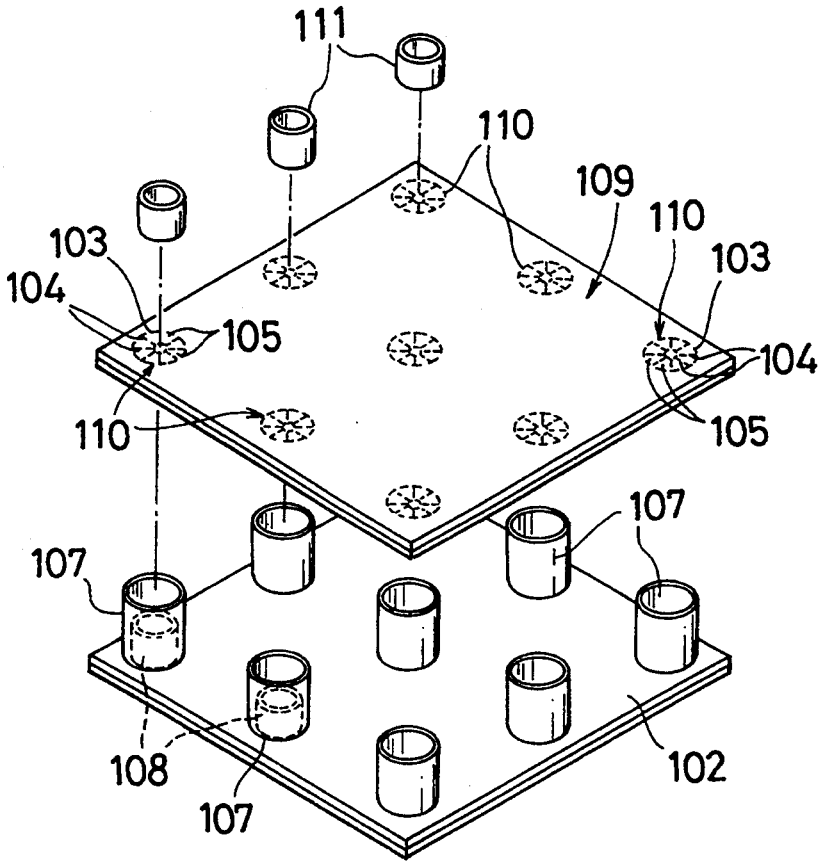
FIG. 10 is a perspective view showing an arrangement of a first table element, a second table element and a second inner leg element in the cardboard pallet of the second embodiment shown in FIG. 9.
Figure 11:
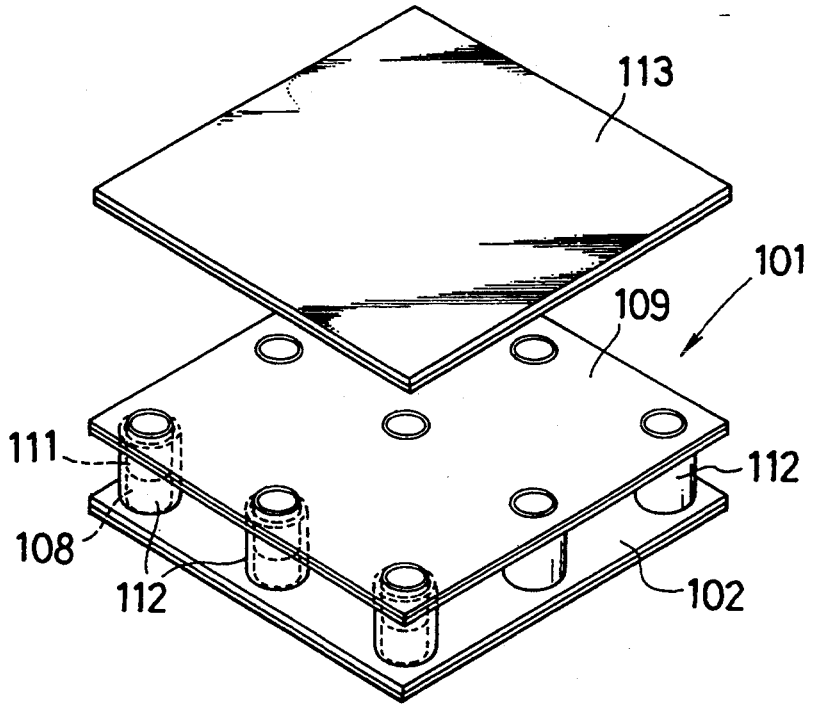
FIG. 11 is a perspective view showing an arrangement of an upper plate and the cardboard pallet of FIG. 9.
Figure 12:
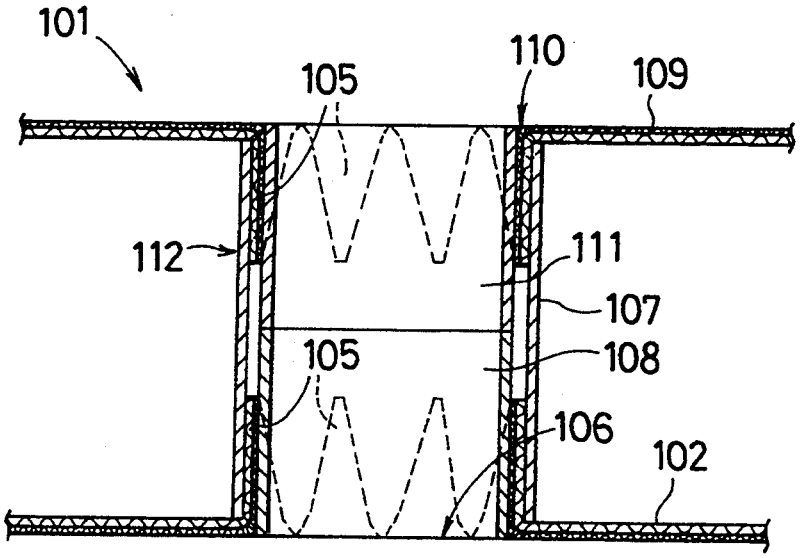
FIG. 12 is a vertical sectional view of the cardboard pallet of FIG. 9.
Figure 13:
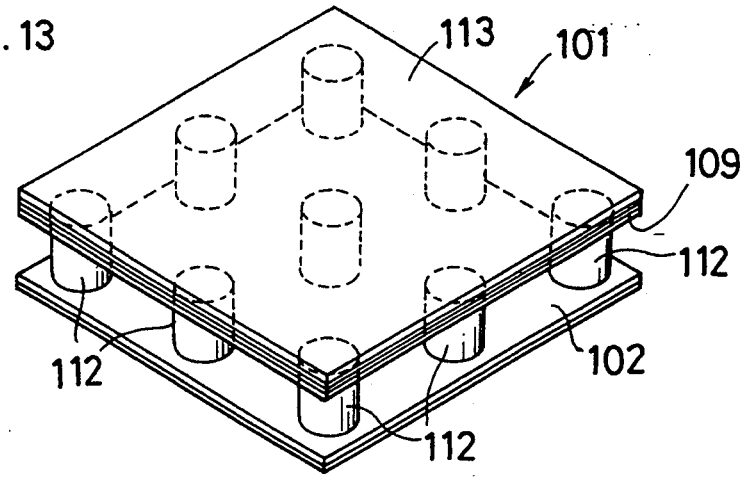
FIG. 13 is a perspective view of the cardboard pallet having the upper plate adhered thereto.
Figure 14:
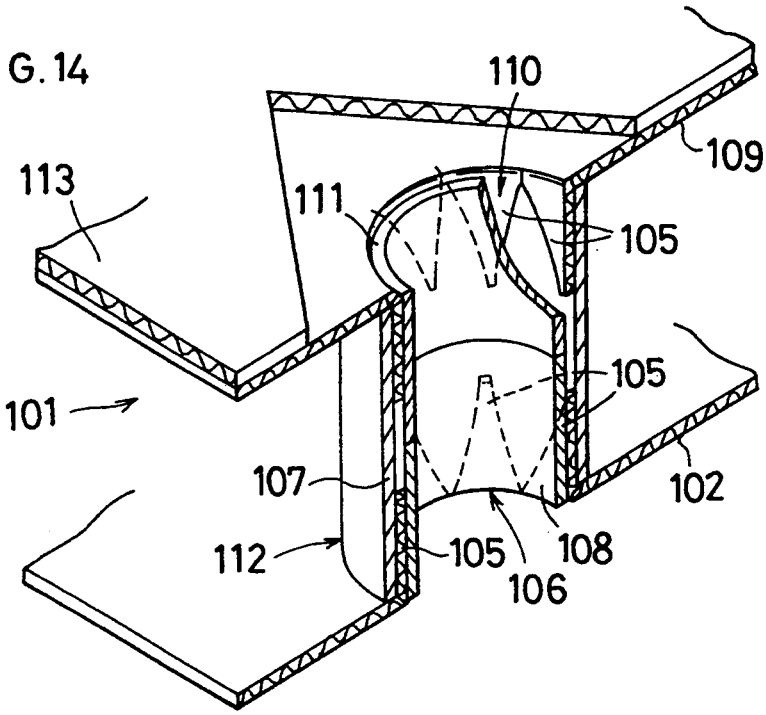
FIG. 14 is an enlarged perspective view having cutout portions of a portion of the pallet shown in FIG. 13.
Figure 15:
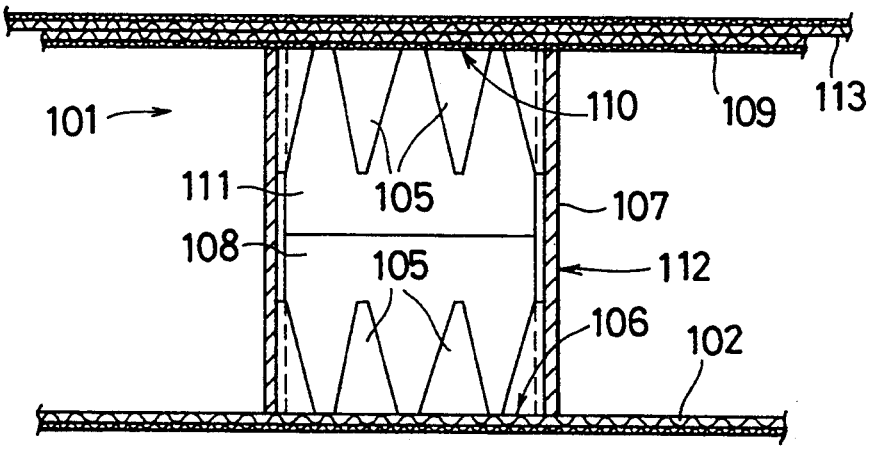
FIG. 15 is a vertical sectional view of the pallet shown in FIG. 14.

As shown in FIG. 7, the first pushing mechanism 24 comprises a lower support 41 and an upper support 42 both of which are opposed vertically so as to be moved vertically by means of an actuating cylinder and the like. The lower support 41 and the upper support 42 have stepped portions formed at their mid portions by reducing diameters of their leading end portions. As shown in FIGS. 7 and 8, the pushing mechanism 24 is adapted to hold the inner leg element 8 uprightly on the lower support 41 with its lower portion fitted to the upper portion of the support 41 and to hold the outer leg portion 7 by the upper support 42 with its upper portion fitted to the lower portion of the support 42 through a friction force and the like provided therebetween.

Incidentally, the first pushing mechanism 24 is provided with three sets of the lower supports 41 and the upper supports 42 arranged transversely so as to be opposed to each other,so that the respective first attachment portions 6 and the respective second attachment portions 10 arranged transversely in the first table element 2 and in the second table element 9 respectively can be processed simultaneously.

Accordingly, when the table element 2 is moved along the transfer line 22 intermittently and a first transverse row of the attachment portions 6 arranged at the front end portion of the table element 2 reaches the adhesive application mechanism 23, the movable application member 33 is brought into pressed contact with the upper surface of the attachment portion 6 and also the lower surface of the attachment portion 6 is brought into pressed contact with the fixed application member 31 by a lowering actuation of the cylinder 32 during an instantaneous stop of the table element 2, so that both the upper and the lower surfaces of the attachment portion 6 can be applied with the adhesive. Then, when the transverse row of the attachment portions 6 applied with the adhesive reaches the pushing mechanism 24, the upper supports 42 holding the upper portions of the outer leg elements 7 are so lowered that the lower ends of the outer leg elements 7 can be located at the attachment portions 6 of the table element 2 while the lower supports 41 holding the lower portions of the inner leg element 8 uprightly are so raised that the inner leg elements 8 can be located at the lower surfaces of the attachment portions 6 and continuously pushed upward into the outer leg elements 7 from below. When this operation is completed, the lower supports 41 are lowered so as to come out of the inner leg elements 8 and the upper supports 42 are raised so as to come out of the outer leg elements 7, so that the outer leg elements 7 are secured in the upright manner at the same time to the transverse row of three attachment portions 6.

Accordingly, since the cardboard pallet 1 can be fabricated automatically when the first table element 2 has passed through the pushing mechanism 24, an adhesion mechanism for an upper plate 13 may be located behind the pushing mechanism 27 if required so that the upper plate 13 can adhere to the outer surface of the cardboard pallet 1.

In the above-mentioned fablicating apparatus 21, a stocker 28 for the outer leg elements 7 and a stocker not illustrated for the first inner leg elements 8 are disposed vertically behind portion of the transfer line 22 respectively while the outer 5 leg element 7 and the first inner leg element 8 are adapted to be supplied in order to the pushing mechanism 24 by a vibrator mechanism. A movement mechanism for the transfer line 22 and the transfer line 25, a raising and lowering mechanism for the movable application member 33 of the 10 adhesive application mechanism 23 and a raising and lowering mechanism for the lower support 41 and the upper support 42 of the pushing mechanism 24 are adapted to be operated extremely precisely and at a high speed under an electronic control so as to fabricate the cardboard pallets 1 continuously and automatically.

FIGS. 9 through 15 show a method for fabricating another type of cardboard pallet 101. This method for fabricating the cardboard pallet 101 further comprises an addition step for additionally placing a second table element having second attachment portions applied with the adhesive onto the upper open end portions of the outer leg elements of the cardboard pallet 1 fabricated according to the similar steps to the above-mentioned steps and a pushing step for pushing second inner leg elements into the outer leg elements.

The fabricating method will be explained in detail hereinafter.

According to a similar method to that in the above-mentioned first embodiment, leg members 112 are secured integrally to a first table element 102 in an upright manner. Thereupon, the first table element 102 employs an inner leg element 108 having a length half of a length of an outer leg element 107 corresponding thereto.

Then, a second flat table element 109 is placed onto open ends of the outer leg elements 107 of the cardboard pallet 1 formed by the same method as that in the first embodiment. Similarly to the first table element 102, also the second table element 109 has second attachment portions 110 constructed and arranged similarly to the first attachment portions 106.

Therefore, the second table element 109 having the upper and the lower surfaces of the respective attachment portions 110 applied with the adhesive is so placed that the respective attachment portions 110 coincide with the open end portions of the leg members 112, and then second inner leg elements 111 constructed similarly to the first inner leg elements 108 are applied from the upper surface of the second table element 109 and pushed downward. Thereupon, the second inner leg element 110 enters the upper half portion of the outer leg element 107 while bonding adhesion finger members 105 of the second attachment portions 110 so that the finger members 105 of the second attachment portion 110 are held between the inner surface of the outer leg element 107 and the outer surface of the second inner leg element 111. The second inner leg element 111 is to be pushed till it comes into contact with the first inner leg element 108 so as to be fitted in the outer leg element 107.

In that way, by holding the respective adhesion finger members 105 between the first and the second inner leg elements 108 and 111 with the outer leg elements 107 held between the respective first attachment portions 106 of the first table element 102 and the respective second attachment portions 110 of the second table element 110, it becomes possible to provide the leg members 112 composed of the outer leg elements 107, the adhesion finger members 105 and the first or the second inner leg elements 108 or 111 in an overlapped manner between the first attachment portions 106 of the first table element 102 and the second attachment portions 110 of the second table element 109, so that the cardboard pallet 101 can be composed of the first table element 102, the second table element 109 and the plurality of leg members 112.

Since through-holes are formed in the cardboard pallet 101 at the positions of the first attachment portions 106 or the second attachment portions 110 by the first tubular leg elements 108 or the second tubular leg elements 111, an addition plate 113 made of a cardboard or a corrugated cardboard for plugging the openings of the through-holes, providing an aethetic outlook or adding a reinforcement effect may be made to adhere to one or both of the surface of the first table element 102 and the surface of the second table element 109 if required.

Figure 16:
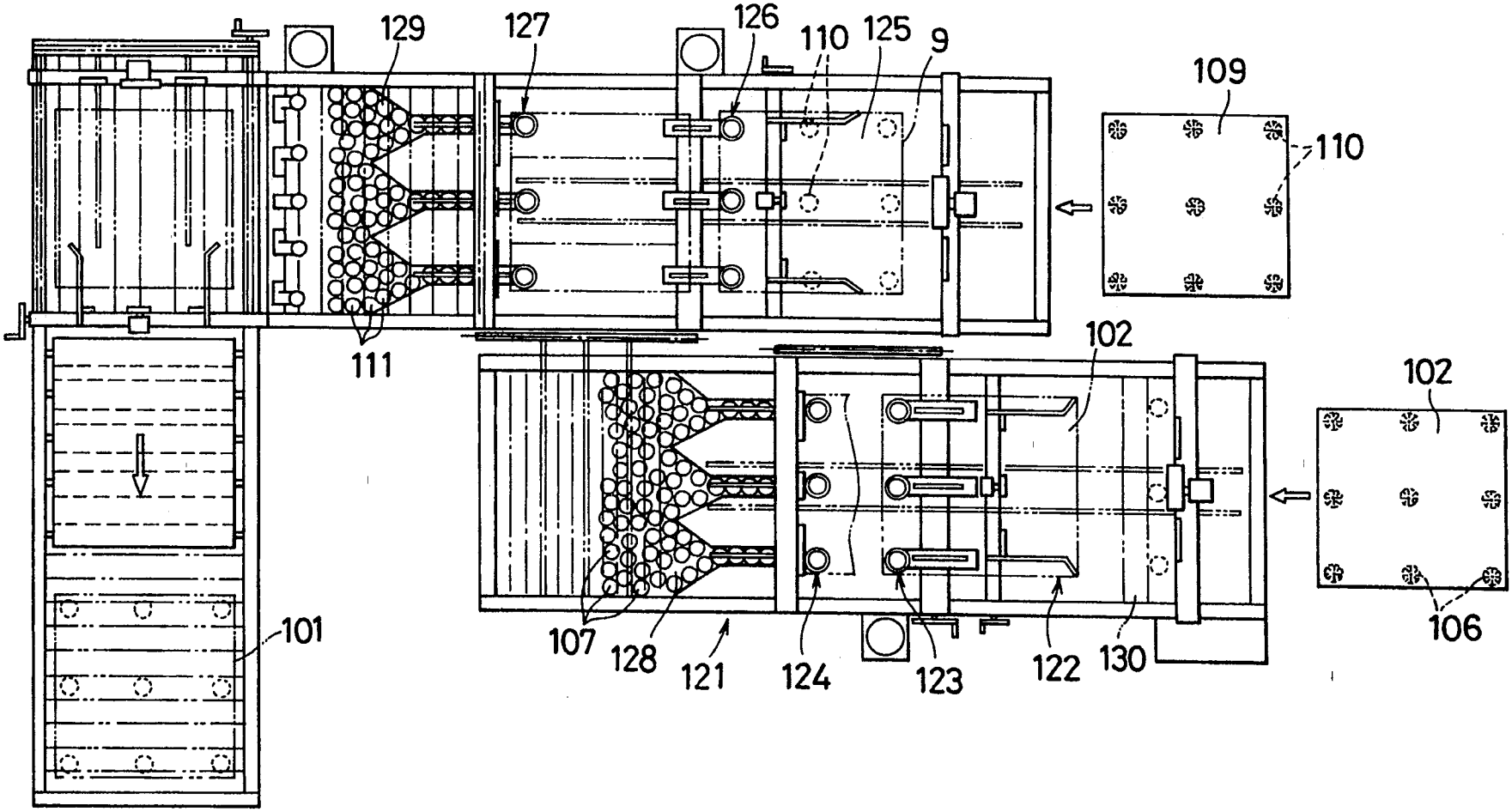
FIG. 16 is a schematic plan view of an apparatus for fabricating a cardboard pallet according to the second embodiment.
Figure 17:
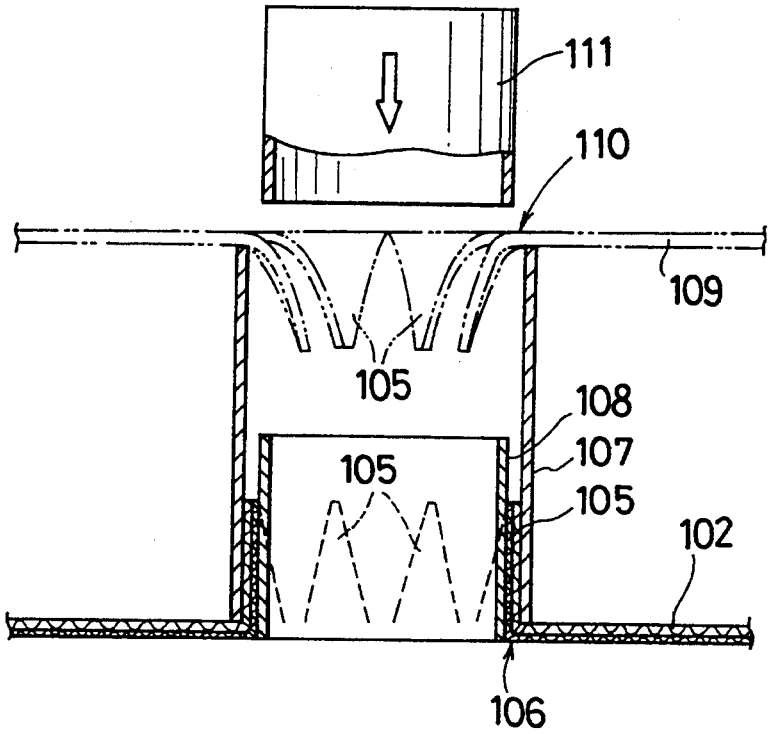
FIG. 17 is a schematic side view of a second pushing mechanism in such a state that the second inner leg element is going to be fitted into the outer leg element.

FIG. 16 shows a schematic plan view of a fabricating apparatus 121 for fabricating the cardboard pallet 101. A first adhesive application mechanism 123 for applying the adhesive onto the upper surfaces and the lower surfaces of the first attachment portions 106 is provided at a midway position of the transfer line 22 while a first pushing mechanism 124 for pushing and fitting the first inner leg element 108 into the outer leg element 107 is provided behind the first adhesive application mechanism 123.

Further, a second adhesive application mechanism 126 for applying the adhesive onto the upper and lower surfaces of the second attachment portions 10 is disposed in a midway portion of the transfer line 125 for the second table element 109 arranged in parallel adjacently to the above-mentioned transfer line 22 while a second pushing mechanism 127 for pushing the second inner leg elements 111 into the outer leg elements 107 is disposed behind the second adhesive application mechanism 126.

The transfer line 125 is provided at its upper and lower portions with chain-conveyers so as to intermittently move the first table element 102 along its lower portion and the second table element 109 along its upper portion at the same speed.

The first adhesive application mechanism 123 and the second adhesive application mechanism 126 are constructed similarly to the adhesive application mechanism 123 in the first embodiment as shown in FIG. 6, so that the upper surfaces and the lower surfaces of the attachment portions 106 of the first table element 102 and the attachment portions 110 of the second table element 109 can be applied with the adhesive simultaneously.

Further, the first pushing mechanism 124 and the second pushing mechanism 127 are constructed substantially similarly to the pushing mechanism 24 in the above-mentioned embodiment as shown in FIG. 7, comprising the lower support 41 and the upper support 42 beth of which are opposed vertically to each other so as to be moved by actuation cylinders and the likes. The lower support 41 and the upper support 42 have stepped portions formed at their mid portions, namely having their leading end portion diameters reduced respectively. Therefore, as shown in FIG. 7, the first pushing mechanism 124 is adapted to make the lower portion of the first inner leg element 8 fit to the upper portion of the lower support 41 so as to hold it uprightly and to make the upper portion of the outer leg element 7 fit to the lower portion of the upper support 42 so as to hold it by a friction force and the like.

Figure 18:
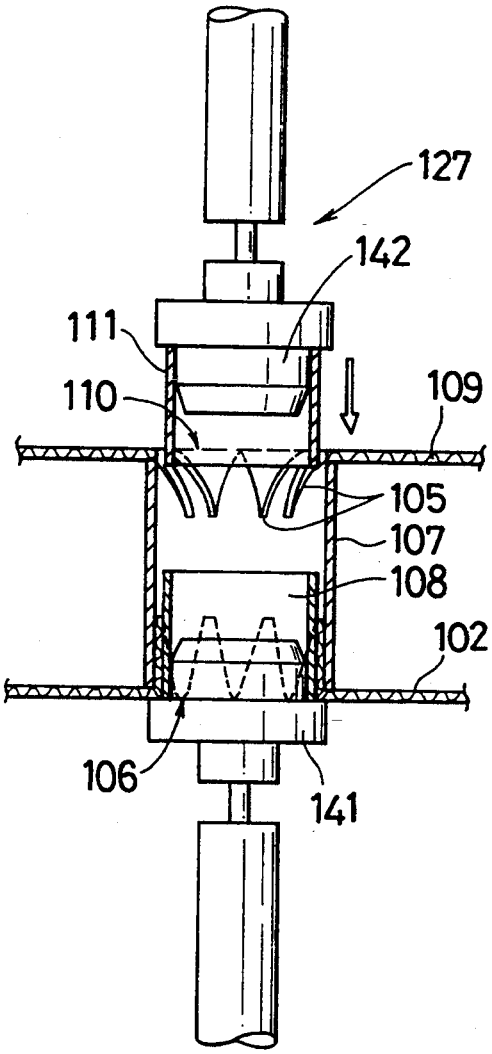
FIG. 18 is a schematic side view showing an operational state of the second pushing mechanism.

As shown in FIG. 18, the second pushing mechanism 127 is adapted to make the lower portion of the first inner leg element 108 fit to the upper portion of the lower support 141 so as to hold it and to make the upper portion of the second inner leg element 111 fit to the lower portion of the upper support 142 so as to hold it by a friction force and the like.

Incidentally, in the first pushing mechanism 124 and the second pushing mechanism 127 there are provided transversely three sets of lower supports 141 and upper supports 142 opposed to each other vertically so as to process the respective first attachment portions 106 arranged transversely in the first table element 2 and the respective second attachment portions 110 arranged transversely in the second table element 9 simultaneously.

Accordingly, when the first table element 102 moves along the transfer line 122 intermittently so that a first transverse row of the attachment portions 106 arranged at the front end portion of the table element 102 reaches the adhesive application mechanism 123, the movable application member 133 is brought into pressed contact with the upper surface of the attachment portion 106 and also the lower surface of the attachment portion 106 is brought into pressed contact with the fixed application member 31 by a lowering actuation of the cylinder 132 during an instantaneous stop of the first table element 102 so that both the upper and the lower surfaces of the first attachment portion 106 can be applied with the adhesive. When the transverse row of the first attachment portions 106 applied with the adhesive reaches the first pushing mechanism 124, the upper supports 142 holding the upper portions of the outer leg elements 107 are so lowered that the lower ends of the outer leg elements 107 can be located at the first attachment portions 106 of the first table element 102 while the lower supports 141 holding the lower portions of the first inner leg elements 108 uprightly are so raised that the first inner leg elements 108 can be located at the lower surfaces of the first attachment portions 106 and then further pushed upward into the outer leg elements 107 from below. When this operation is completed, since the lower supports 14 are lowered and the upper support 42 are raised, the lower support 14 and the upper support 142 are pulled out of the first inner leg elements 108 and the outer leg elements 107 so that the outer leg elements 107 can be secured at once uprightly to the respective three first attachment portions 106 arranged transversely.

After that the outer leg elements 107 have been secured uprightly to all of the first attachment portions 106 of the first table element 102, the first table element 102 is transferred from the transfer line 122 to the lower portion of the transfer line 125 so that the second table element 109 and the first table element 102 can be moved intermittently along the upper portion of the transfer line 125 and along the lower portion thereof in the same states at the same locations respectively.

In the second adhesive application mechanism 126, the respective attachment portions 110 of the second table elements 109 are applied with the adhesive by the same construction and the same operation as those of the above-mentioned adhesive application mechanism 123. In the second pushing mechanism 127, the lower supports 141 are so raised as to fit into the lower portions of the first inner leg elements 108 while the upper supports 142 holding the second inner leg elements 111 at their lower portions are lowered so as to push and fit the second inner leg elements 111 into the upper portions of the outer leg elements 107. Accordingly, when the first table element 102 and the second table element 109 have passed through the second pushing mechanism 127, the 25 cardboard pallet 101 is fabricated automatically. If required, an adhesion mechanism for an upper surface plate 113 may be disposed behind the second pushing mechanism 127 so as to make the upper surface plate 113 adhere to the outer surface of the cardboard pallet 101.

In the above-mentioned fabricating apparatus 121, a stocker 128 for the outer leg elements 107 and a stocker (not illustrated) for the first inner leg elements 108 are provided vertically behind the transfer line 122 so as to deliver the outer leg elements 107 and the first inner leg elements 108 to the first pushing mechanism 124 in order by a vibrator mechanism. Further, a stocker 129 for the second inner leg elements 111 is provided at the back portion of the transfer line 125 so as to deliver the second inner leg elements 111 to the second pushing mechanism 127 in order by a vibrator mechanism. A movement mechanism for the transfer line 122 and the transfer line 125, a raising and lowering mechanism for fixed application members and the the movable application members 133 of the first adhesive application mechanism 123 and the second adhesive application mechanism 126 and a raising and lowering mechanism for the lower supports 141 and the upper supports 142 of the first pushing mechanism 124 and the second pushing mechanism 127 are adapted to be operated extremely precisely and at a high speed under an electronic control so as to fabricate the cardboard pallets 101 continuously and automatically.

In the respective above-mentioned embodiments, explanation have been made explanations about the fabrications of the cardboard pallets 1, 101 employing the table elements 2, 102 provided with the attachment portions 6, 106 previously or the table element 109 provided with the second attachment portions 110 previously. But, an attachment portion forming mechanism 30, 130 indicated by a phantom line figure in FIGS. 5 and 16 may be disposed before the adhesive application mechanism 23 in the above-mentioned apparatus 21 or the first adhesive application mechanism 123 in the above-mentioned apparatus 121, so that the adhesive application process can be performed after the formation of the attachment portion 6, 106 in the table element 2, 102.

Though the present invention has been described with reference to the illustrated embodiments, the invention is not limited to the above-mentioned embodiments but may be modified in any manner without departing from the spirit and scope of the invention as set forth in the claims appended thereto.

For example, the first table element 102 and the second table element 109 may be moved in a vertical posture while the leg members may be composed of the outer leg elements 107, the first inner leg elements 108 and the second inner leg elements 111 adapted to be moved laterally in a horizontal posture. Further, the outer leg elements 107 and the first inner leg elements 108 may be secured to the lower surface of the first table element 102 so that the second table element 109 may be secured to the lower ends of the outer leg elements 107 by the second inner leg elements 111.

What is claimed is:

1. A method for fabricating a cardboard pallet comprising the steps of:

applying adhesive to both side surfaces of a row of attachment portions, said attachment portions being arranged in plural rows that are spaced a predetermined distance range in a cardboard table element, each said attachment portion having a plurality of adhesion finger members formed by die-cut lines defined inside of a phantom folding line, the adhesive being applied to each row of attachment portions successively;

intermittently advancing the cardboard table element by said predetermined distance range;

arranging one open end of an outer leg element formed of tubular cardboard at one side surface of each attachment portion in said row of attachment portions that have been applied with the adhesive so as to be in contact therewith and an inner leg element formed of tubular cardboard at the other side surface of said attachment portion in alignment with the one open end of said outer leg element;

simultaneously pushing each said inner leg element within said row of attachment portions into a corresponding said outer leg element to hold and secure the adhesion finger members of said attachment portion between the outer leg element and the inner leg element; and repeating the steps of said method so as to secure an outer leg element uprightly at every attachments portion on one side surface of the cardboard table element.

2. A method for fabricating a cardboard pallet comprising the steps of:

applying adhesive to both side surfaces of a row of first attachment portions, said attachment portions being arranged in plural rows that are spaced a predetermined distance range in a first cardboard table element, each said first attachment portion having a plurality of adhesion finger members formed by die-cut lines defined inside of a phantom folding line, the adhesive being applied to each row of attachment portions successively;

intermittently advancing the first cardboard table element by said predetermined distance range;

arranging one open end of an outer leg element formed of tubular cardboard at one side surface of each first attachment portion in said row of first attachment portions that have been applied with the adhesive so as be in contact therewith and a first inner leg element formed of tubular cardboard at the other side surface of said first attachment portion in alignment with the one open end of said outer leg element;

simultaneously pushing each said first inner leg element within said row of first attachment portions into a corresponding outer leg element to hold an secure the adhesion finger members of said first attachment portion between the outer leg element and the first inner leg element so as to secure the outer leg element uprightly at every first attachment portion on one side surface of the first table element on a row by row basis;

applying adhesive to both side surfaces of a row of second attachment portions, said attachment portions being arranged in plural rows that are spaced a predetermined distance range in a second cardboard table element, each said second attachment portion having a plurality of adhesion finger members formed by die-cut lines defined inside of a phantom folding line, the adhesive being applied to each row of attachment portions successively;

intermittently advancing the second cardboard table element by said predetermined distance range;

arranging each said attachment portion formed in the second table element so as to be in contact with a respective open end of each said outer leg element erected on the first table element and also a second inner leg element formed of tubular cardboard at the other side surface of said second table element; and pushing each said second inner leg element within said row of second attachment portions into a corresponding said outer leg element to hold and secure the adhesion finger members of said second attachment portion between the outer leg element and the second inner leg element so as to secure a plurality of leg members composed of the outer leg elements, the adhesion finger members and the first and the second inner leg elements between the first table element and the second table element.

3. An apparatus for fabricating a cardboard pallet comprising:

an adhesive application mechanism for applying adhesive to both side surfaces of a row of attachment portions, said attachment portions being arranged in plural rows that are spaced a predetermined distance range in a cardboard table element, each said attachment portion having a plurality of adhesion finger members formed by a plurality of die-cut lines defined inside of a phantom folding line;

a conveying mechanism for intermittently advancing, by said predetermined distance range, the cardboard table element such that successive rows of attachment portions are positioned within said adhesive application mechanism;

a leg arranging mechanism for arranging one open end of an outer leg element formed of tubular cardboard at one side surface of each attachment portion in said row of attachment portions that have been applied with the adhesive by the adhesive application mechanism so as to be in contact therewith and an inner leg element formed of tubular cardboard at the other side surface of said attachment portion in alignment with the one open end of said outer leg element; and a pushing mechanism for simultaneously pushing each said inner leg element within said row of attachment portions into a corresponding said outer leg element to hold and secure the adhesion finger members of each said attachment portion between the outer leg element and the inner leg element wherein an outer leg element is secured uprightly to every attachment portion on one side surface of the cardboard table element.

4. An apparatus for fabricating a cardboard pallet comprising:

a first adhesive application mechanism for applying adhesive to both side surfaces of a row of first attachment portions, said first attachment portions being arranged in plural rows that are spaced a first predetermined distance range in a first cardboard table element, each said first attachment portion having a plurality of adhesion finger members formed by a plurality of die-cut lines defined inside of a phantom folding line;

a first conveying mechanism for intermittently advancing, by said first predetermined distance range, the first cardboard table element such that successive rows of said first attachment portions are positioned within said first adhesive application mechanism;

a first leg arranging mechanism for arranging one open end of an outer leg element formed of tubular cardboard at one side surface of each first attachment portion in said row of first attachment portions that have been applied with the adhesive so as to be in contact therewith and a first inner leg element formed of tubular cardboard at the other side surface of said first attachment portion in alignment with the One Open end of said outer leg element;

a first pushing mechanism for simultaneously pushing each said first inner leg element within said row of first attachment portions into a corresponding said outer leg element to hold and secure the adhesion finger members of said first attachment portion between the outer leg element and the first inner leg element wherein an outer leg element is secured uprightly to every first attachment portion on one side surface of the first cardboard table element;

a second adhesive application mechanism for applying adhesive to both side surfaces of a row of second attachment portions, said second attachment portions being arranged in plural rows that are spaced on second predetermined distance range in a second cardboard table element, each said second attachment portion having a plurality of adhesion finger members formed by a plurality of die-cut lines defined inside of a phantom folding line;

a second conveying mechanism for intermittently advancing, by said second predetermined distance range, the second cardboard table element such that successive rows of said second attachment portions are positioned within second adhesive application mechanism;

a second leg arranging mechanism for arranging each said second attachment portion formed in the second cardboard table element so as to be in contact with a respective open end of each said outer leg element erected on the first cardboard table element and also a second inner leg element formed of tubular cardboard at the other side surface of said Second attachment portion; and a second pushing mechanism for simultaneously pushing each said second inner leg element within said, row of second attachment potions into a corresponding said outer leg element to hold and secure the adhesion finger members of said second attachment portion between the corresponding outer and inner leg elements so as to secure a plurality of leg members composed of the outer leg elements, the adhesion finger members and the first and second inner leg elements between the first cardboard table element and the second cardboard table element.

5. An apparatus for fabricating a cardboard pallet as set forth in claim 4, wherein a location where the first adhesive application mechanism (123) is disposed and a location where the first leg arranging mechanism is disposed are connected by a transfer mechanism (122) while a location where the first pushing mechanism (124) is disposed and a location where the second leg arranging mechanism is disposed are connected thereby.

* * * * *